United States Patent [19]

Dreyfus

[11] Patent Number: 4,871,068

[45] Date of Patent: Oct. 3, 1989

[54] PACKAGING ARRANGEMENT FOR A GROUP OF CONTAINERS INCLUDING A HANDLE ON A TYING STRAP

[75] Inventor: Roger Dreyfus, Strasbourg, France

[73] Assignee: I.C.P., S.A., Fegersheim, France

[21] Appl. No.: 206,892

[22] Filed: Jun. 15, 1988

Related U.S. Application Data

[63] Continuation of Ser. No. 943,666, Dec. 18, 1986, abandoned.

[30] Foreign Application Priority Data

Dec. 18, 1985 [FR] France ..... 85 18900
Dec. 18, 1985 [FR] France ..... 85 18901

[51] Int. Cl.[4] ..... B65D 5/46

[52] U.S. Cl. ..... 206/428; 53/48; 53/135; 53/398; 53/399; 53/413; 53/462; 53/543; 53/582; 206/200; 229/109; 229/117.24; 294/149

[58] Field of Search ..... 206/427-429, 206/439, 142, 200, 150; 229/40, 52 AL, 108, 110, 109, 113; 294/149, 150, 153, 156; 53/413, 448, 462, 398, 399, 48, 543, 582, 134, 135, 207

[56] References Cited

U.S. PATENT DOCUMENTS

| | | | |
|---|---|---|---|
| 2,433,676 | 12/1947 | Ringler | 229/109 X |
| 2,783,690 | 3/1957 | Crary et al. | 206/429 X |
| 3,209,982 | 10/1965 | Laster et al. | 206/428 X |
| 3,817,018 | 6/1974 | Vickers | 53/207 X |
| 3,872,650 | 3/1975 | Vickers | 53/207 |
| 4,269,314 | 5/1981 | Barrash | 206/428 |
| 4,295,598 | 10/1981 | Calvert | 229/52 AL |
| 4,301,922 | 11/1981 | Havelin et al. | 206/428 |
| 4,382,511 | 5/1983 | Havelin et al. | 206/427 |
| 4,471,870 | 9/1984 | Uhlig | 206/150 |
| 4,582,211 | 4/1986 | Mandel | 220/3 |
| 4,642,967 | 2/1987 | Culpepper | 53/398 |
| 4,715,493 | 12/1987 | Dreyfus | 206/200 |

FOREIGN PATENT DOCUMENTS

| | | | |
|---|---|---|---|
| 0072089 | 2/1983 | European Pat. Off. | 206/427 |
| 2302244 | 9/1976 | France | 206/427 |
| 0138449 | 2/1920 | United Kingdom | 294/150 |
| 995918 | 6/1965 | United Kingdom | 294/153 |
| 2096972 | 10/1982 | United Kingdom | 206/427 |

*Primary Examiner*—Stephen Marcus
*Assistant Examiner*—Bryon Gehman
*Attorney, Agent, or Firm*—Schwartz & Weinrieb

[57] ABSTRACT

A packaging arrangement for a group of containers includes a tray-shaped bottom including a planar bottom wall and circumferential walls extending substantially normal to the plane of the bottom wall to form a rim which initially confines the containers in their positions during the formation of the packaging arrangement. The packaging arrangement further includes a strap-shaped typing member that encircles the containers and ultimately confines them in their positions and that carries a handle by which the packaging arrangement and the containers accommodated therein can be held. A separate cover to be joined to the tray-shaped bottom and surrounding the containers and the strap-shaped typing member encircling the same completes the packaging arrangement and has an opening for the passage of the handle from the interior to the exterior of the cover.

20 Claims, 8 Drawing Sheets

FIG. 2
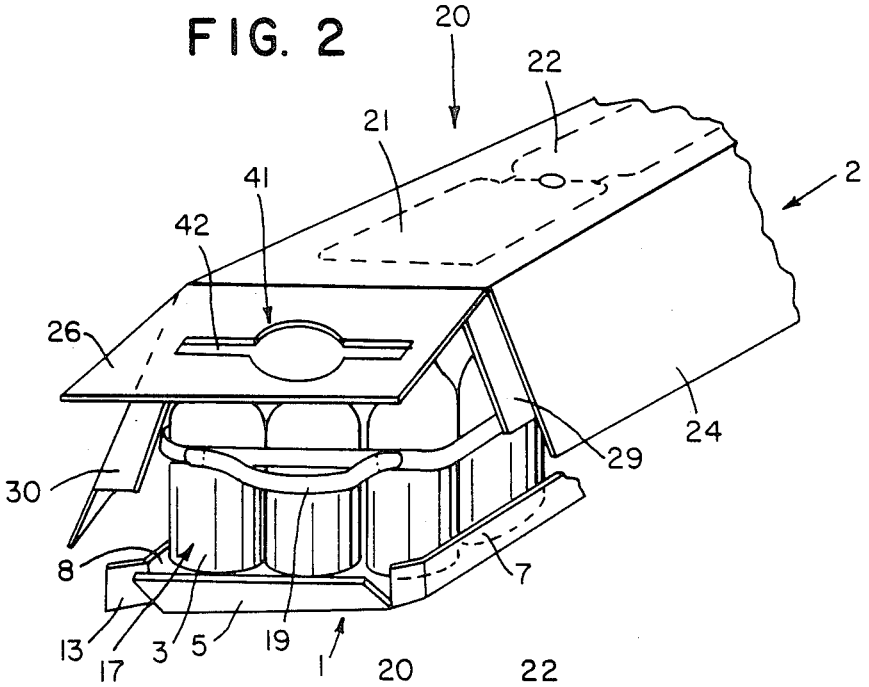
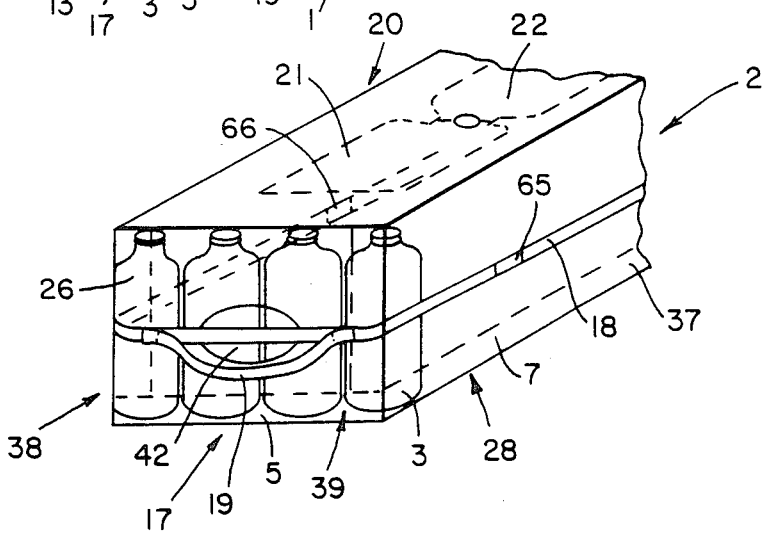
FIG. 3

FIG. 17
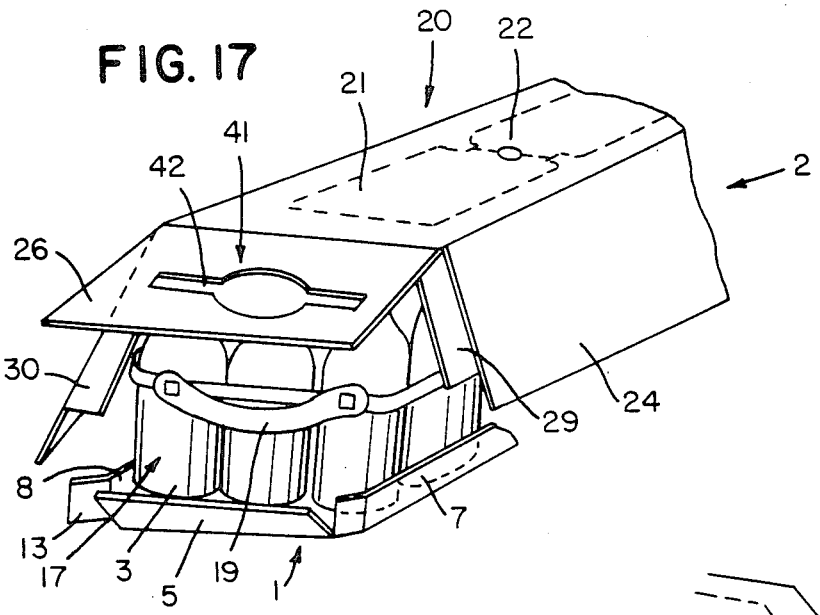
FIG. 18A
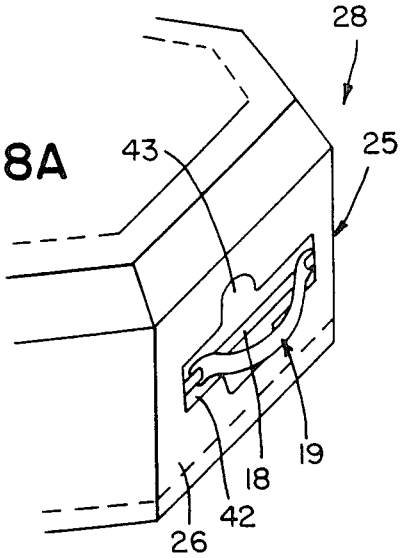
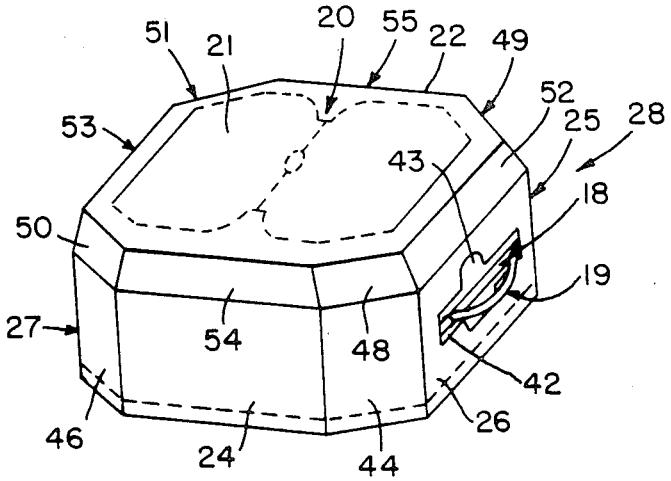
FIG. 18

PACKAGING ARRANGEMENT FOR A GROUP OF CONTAINERS INCLUDING A HANDLE ON A TYING STRAP

This application is a continuation of application Ser. No. 943,666, filed Dec. 18, 1986, now abandoned.

The present invention relates to a package for a group of items and a process for its manufacture.

A package designed to be wrapped around a group of containers encircled by a strap includes an integrated handle, the bottom being of a tray-shaped type whose raised sides form a rim to constitute a confinement and which are linked to a cover of geometrical form through a lower peripheral border of its lateral panel sides, and wherein the aforementioned cover is formed at least on one of the sides of the lateral surfaces with an opening for the passage of the handle formed with the strap, and passed or threaded onto the strap.

FIELD OF THE INVENTION

This invention is of interest to the packaging industry, and in particular in connection with the packaging of small bottles of beverages.

The present invention relates to a package for a group of items comprising a separate bottom having a tray-type structure, a flat encircling strap with a handle integrated with the strap and joined or threaded thereto and a cover.

The invention relates equally to a method of manufacture of the above-mentioned package.

The encirclement by means of a flat strap with an integrated handle of a group of containers and more specifically of a group of small beverage bottles facilitates or insures unification of the group, so that holding and carrying of the same is facilitated due to the package being maintained in the plane of encirclement.

For all practical purposes, however, a single surrounding strap is not sufficient in itself to support the structure, because it cannot assure by itself the holding together of the group of containers, but in addition for reasons of industrial production of the full package wherein there is a need to have a receiving plane for receiving the containers. In addition, one desires an opaque and closed package for general protection against light, dust and other article-deteriorating factors. In effect, a grouping of bottles which is only encircled would in no way fulfill either the technical requirements for cohesion of the arrangment, or the need of the consumer who would immediately dislike the inadequate holding capability of the encircling strap.

OBJECT OF THE INVENTION

The present invention has as its object the remedying of these inconveniences by proposing a package with a separable tray-shaped type bottom which is covered by means of a cover having a predetermined geometrical form after the product to be packaged has been encircled by means of a flat strap which will serve as a handle at a designated place.

SUMMARY OF THE INVENTION

For that purpose, according to the invention, the package is characterized in that the bottom is of a tray-shaped type and is joined to a cover of a predetermined geometrical form whose lower parts of the lateral surfaces are secured to the raised flaps of the tray-shaped portion, the cover being formed on one of the sides thereof with an aperture for the passage therethrough of the integrated strap handle developed to hold the entire group tightly together by means of it being encircled therearound.

The present invention has a number of advantages of which only the principal ones will be cited hereinafter:

existence of a support plane to support the bottles in cooperation with the encircling binding strap with particular attention to the cohesion of the group of containes;

Light and dust protection and concealment of the encircling binding strap;

the possibility of making the bottom out of different respective materials, notably plastic materials;

individualization of the handle function;

exceptional strength of the handle in all forms of implementation;

precision in positioning of the handle;

comfort in carrying and handling;

ease of implementing.

BRIEF DESCRIPTION OF THE DRAWINGS

The technical characteristics and advantages of the invention are contained in the following description, carried out by virtue of example and not limited to the embodiments within the annexed drawings in which:

FIG. 2 is a perspective view with the package half closed with the handle already formed, and showing the plane of encirclement;

FIG. 3 is a partial perspective view of the package showing more particularly the front and the lateral sides in transparency;

FIG. 17 is a perspective view of a half-closed package with the shape of the handle conforming to the variant of FIG. 16;

FIG. 18 is a perspective view of a package with precut panels and side panels with the handle conforming to the variant shown in FIG. 15, with an enlargement of the gripping area;

FIG. 18A is an enlarged view of the portion of FIG. 18 enclosed by means of the circle.

DETAILED DESCRIPTION OF THE ILLUSTRATED EMBODIMENTS

Figure 1:
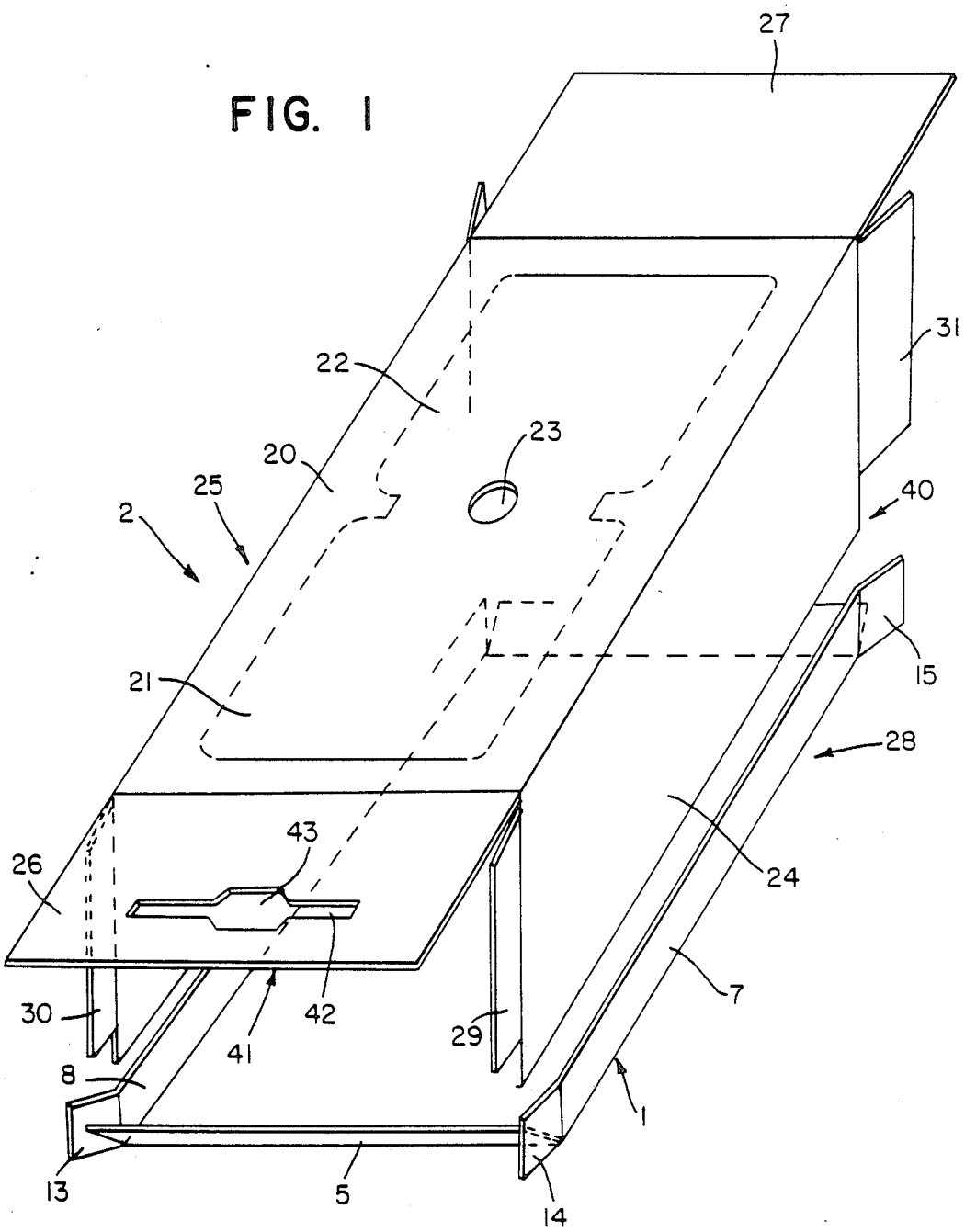
FIG. 1 is a perspective view of the enclosing package, according to the invention, set up in parallelpiped open form, with the bottom and the cover being seperated from each other.

Generally, the concept of the invention is to provide a bottom having a tray-shaped structure which serves as a confining member in a grouping process within a first phase of assembly of the package and upon the bottom of which the different containers are arranged prior to the process of binding the containers together.

The final phase of the assembly of the package is facilitated by means of the integrated strap handle which has been previously mounted upon the strap.

The package with the separable bottom, according to the invention, consists of a bottom 1 of the tray-shaped type, and an enveloping cover 2, of a well-defined geometrical form shaped by means of the foldable material used, for example of compact or corrugated cardboard.

The bottom, for example, is either made of compact or corrugated cardboard, but it can also be made from stiff or semi-stiff sheet material of flat plastic, pressed or thermo-formed according to the shape of the bottom of the containers, for example bottles 3.

In case of cardboard, the bottom 1 is configured in the form of a tray with a central rectangular area 4 bordered by means of bendable lateral flaps 5, 6 and longitudinal flaps 7, 8 joined by means of the folding lines 9,10,11 and 12 to the main area 4. These flaps constitute a peripheral closure, hereinafter called a rim formed by means of a succession of longitudinal and lateral flaps, turned up and joined to one another. In order to accomplish this, they are joined at their ends by means of corner joining flaps 13,14,15, and 16.

These bottoms constitute an essential base of support for the containers after their concentration and individualization into groups such as 17 in the packaging machines, the rim playing the role of a holder in order to cohesively hold the groups together before and during the mechanical encirclement process.

The cover 2 is made to cover the group of containers 17 previously encircled by means of the strap, as for example within plane 18 with an integrated handle 19 integrally made with the strap, or fitted upon the strap, from a material similar to that of the strap, or of any other form equivalent to that of the strap, for example threaded onto the strap as in the illustrated variants of FIGS. 10 and 11, which will be described hereinafter.

The cover provides for complete cohesion of the package and constitutes complete protection against light and dust. As can be seen from the figures, it forms with the bottom an entirely closed envelope through which passes the handle by means of a rectangular opening.

In the embodiment forms shown in FIGS. 1 to 4, the cover 2 has an upper side 20 conventionally having pre-cut access flaps 21 and 22 serving as guards and adapted to form an opening through means of a precut circle 23, which serves, in turn, for the passage of a finger.

The upper face 20 is extended by means of four longitudinal panels 24 and 25 and by lateral panels 26 and 27, bent with respect to the aforesaid upper face 20 by means of folding lines so as to form in the bent position, the lateral sidewalls 28.

Figure 4A:
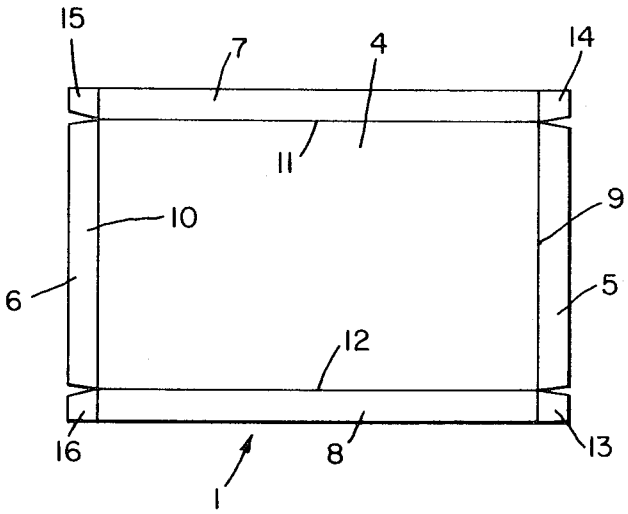
FIG. 4A is a plan view of the flat blank forming the tray portion of the package.
Figure 4:
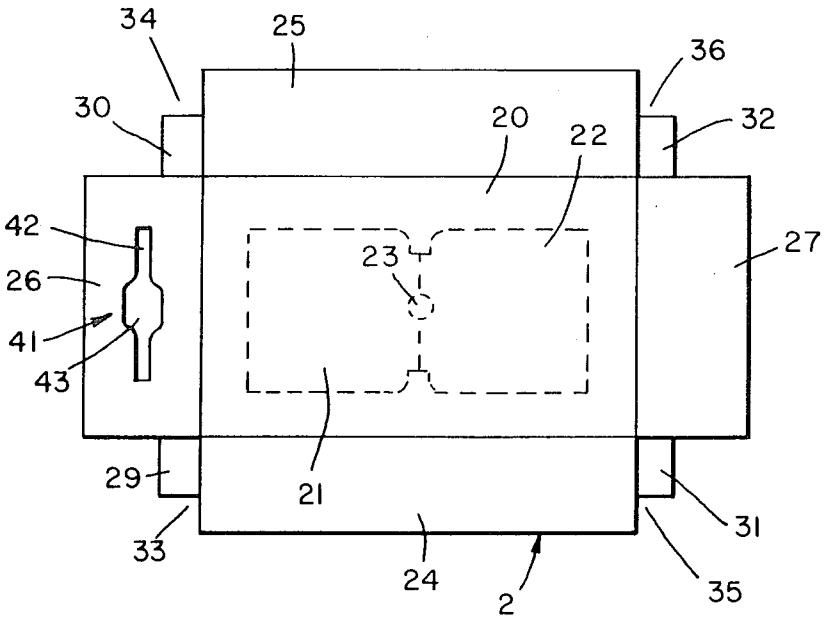
FIG. 4 is a plan view of the flat blank forming the cover portion of the package.

The longitudinal panels are extended upon each end by means of joining flaps 29,30, and 31,32. These joining flaps do not occupy the full width of the panels. A corner recess 33,34,35, and 36 determines the width of the joining areas 37 and 38 upon the longitudinal panels and the joining areas 39 and 40 upon the lateral panels as seen in FIGS. 1, 3, and 4. Joining of the cover and the bottom tray is effected by covering the bottom flaps of the tray by means of the lateral side surface panels of the cover.

The cover is formed on one of its lateral faces or upon both of its sides with an opening 41 for the passage of the integrated handle 19, constituted in part by means of the strap 18 or carried by means of the strap or in another equivalent form.

This passage is preferably formed upon at least one of the lateral sides, that is to say, upon one of the lateral panes 26 or 27 or upon the longitudinal panels 24 or 25 through means of a cut defined for the passage of the strap, for example a slot 42 with an oblong, central opening 43, symmetrical with respect to the slot, and serving to facilitate the passage of the hand for the purpose of gripping the handle 19.

Moreover, the handle 19 can remain flat behind the corresponding lateral side during transportation of the package and at the time of being readied for sale, and can be withdrawn from the slot 42 at the moment when the package is grasped by the consumer.

As indicated, the geometrical forms of the cover can vary.

Figure 6:
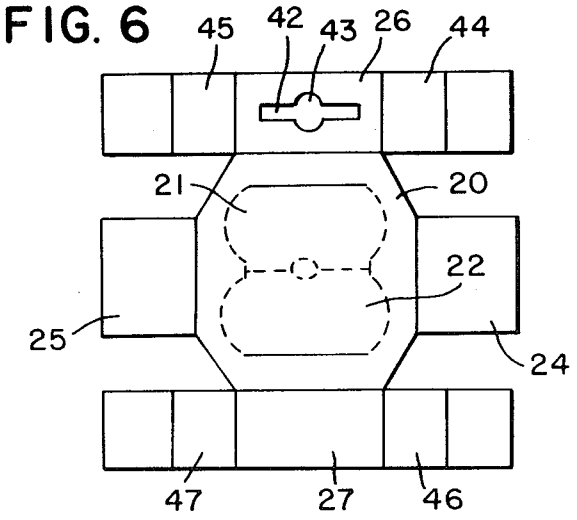
FIG. 5 and 6 are respectively perspective and developed plan views of the cover having pre-cut panels.
Figure 5:
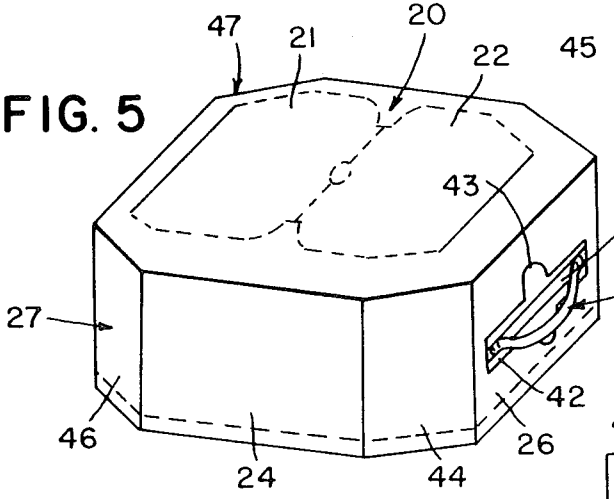

Thus in one embodiment, the cover will assume a parallelpiped geometrical form with the vertical faces 44,45,46,47 disposed (FIGS. 5 and 6) as oblique planes with respect to the side panels 24–27.

In this variant, the opening 42 may be located within one or the other principal lateral sides.

Figure 8:
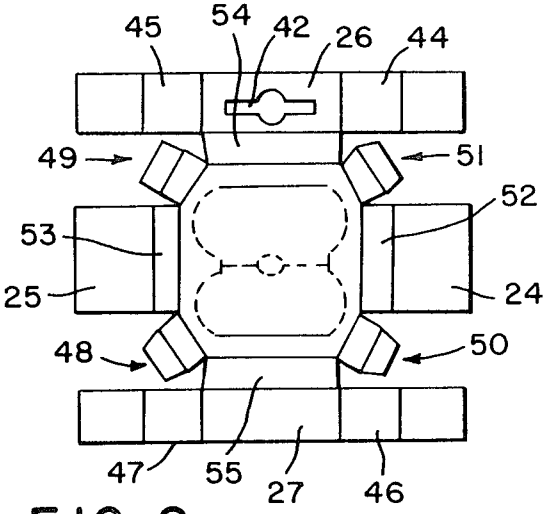
FIG. 7 and 8 are respectively perspective and developed plan views of another embodiment of the cover having pre-cut panels and side panels.
Figure 7:
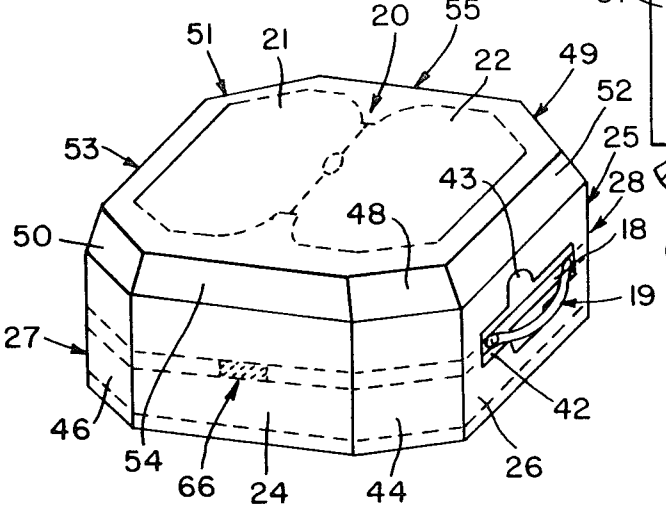

According to a further developed embodiment, the cut sides 44 to 47 are joined with the upper face 20 by means of trapezoidally or triangularly shaped panels 48, 49,50,51 as seen in FIG. 8. This applies also for the main side panels 24 to 27 which are joined with the upper face 20 by means of inclined lateral panels 52 and 53, and longitudinal panels 54 and 55 as seen in FIGS. 7 and 8.

In this last embodiment, the width of the slanted lateral and longitudinal sides must not exceed a certain limit, which is determined by the initial fragility of the lateral face provided with the opening 42 for the passage of the strap.

Figure 9:
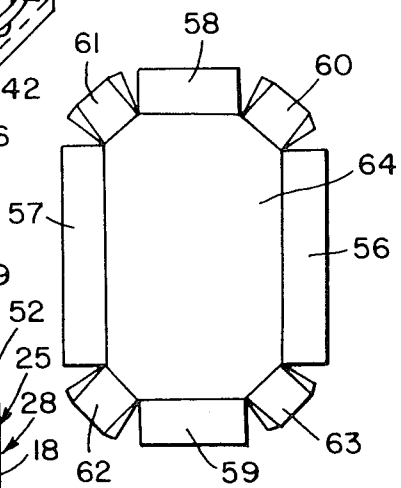
FIG. 9 is a developed plan view of one type of bottom portion which can be used with the two abovementioned variants of the cover as shown in FIGS. 5–8.

Of course, in the abovementioned embodiments, the tray-shaped bottom portion 1, formed to receive the groups of containers, can be common to the embodiments shown in FIGS. 5 to 8. Such a bottom will assume a form precut into a flat symmetrical octogonal form corresponding, for example to that in FIG. 9, with the longitudinal flaps 56,57, the transverse flaps 58 and 59 or the slanted flaps 60,61,62,63 capable of being bent around the folding lines, and delineating a central octagon 64 for the purpose of constituting an upright rim by the joining of the edges to the adjacent flaps, which, in turn are provided, for instance, in the form of slanted flaps.

Figure 13:
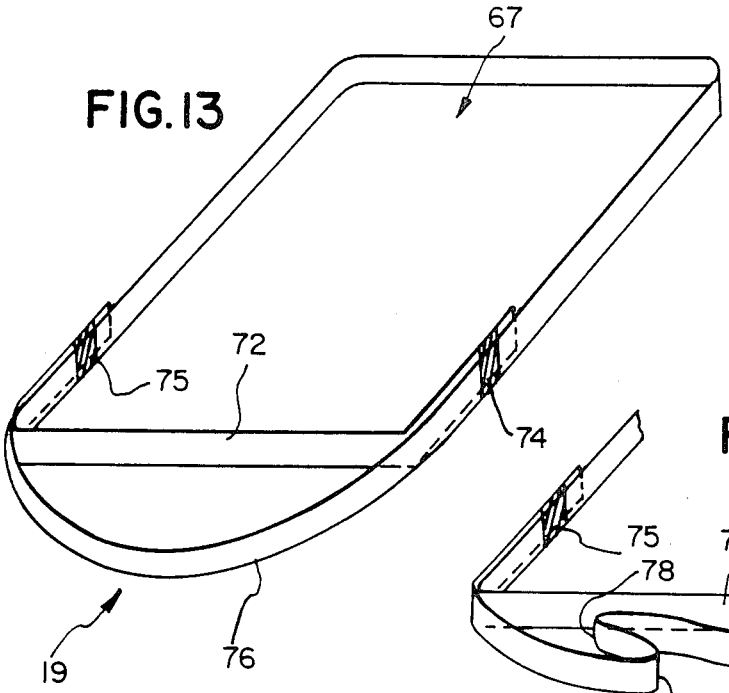
FIG. 13 is a general schematic perspective view showing a type of handle constituted by the flattening of the two ends of the strap.
Figure 14:
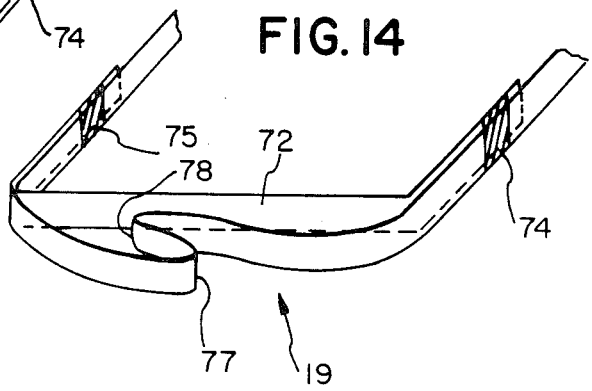
FIG. 14 is a detailed view of the same handle having two intermediate flattened folds.

As the pulling force exerted upon the strap is transmitted to the handle 19 along a longitudinal direction of the package, it proves to be preferable to place the two splices 74 and 75 of the binding strap onto the longitudinal sides, preferably upon the center part as seen in FIGS. 13 and 14. Thus, the main pulling force exerted upon the strap within the plane of the splices is exerted in the longitudinal direction. Therefore, one does not risk any tearing apart of the handle on that level.

Now, the different ways of implementing the integrated handle 19 with reference to the FIGS. 10 to 16 will be examined.

Figure 10:
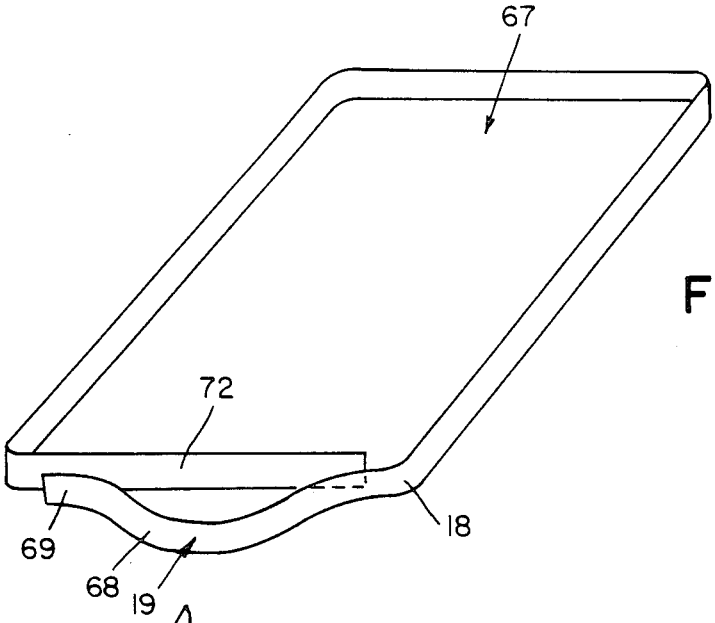
FIG. 10 is a general schematic perspective view showing a type of handle formed with the strap.
Figure 11:
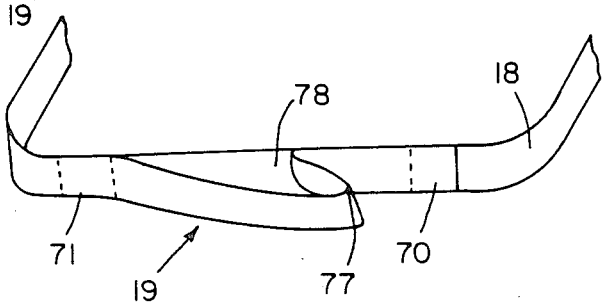
FIG. 11 is a detailed view of the same handle provided with two intermediate flattened folds.
Figure 12:
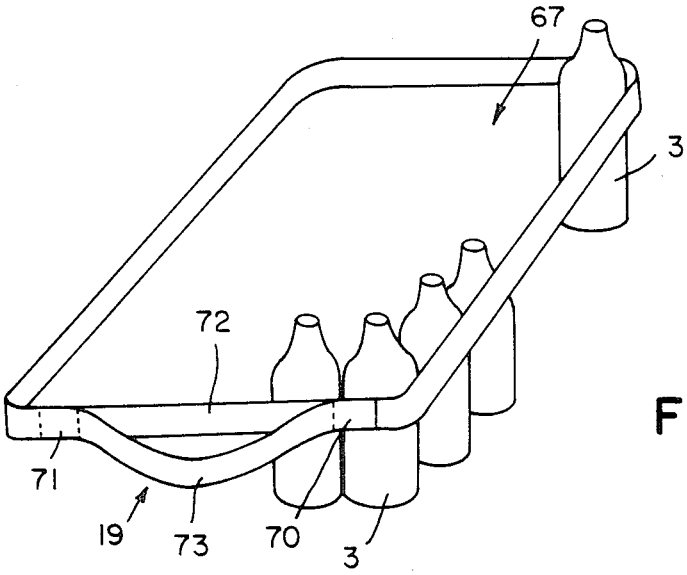
FIG. 12 is a perspective view of the same type of handle shown with a flat encircling binding strap around a portion of the bottles.

At first the handle 19 can be formed integrally with the strap as shown in FIGS. 10,11,and 12.

In accordance with that variant, the strap is divided lengthwise along the circumscribed perimeter 67 in such a way as to present an open-ended extension 68, which will be used to form the handle 19 by flattening it and subsequently joining its end 69 to the remaining portion of the strap.

After encirclement and tightening of the strap by means of splices of gluing of one end of the strap at a first point for closing the circumscribed perimeter with the strap, the end 69 of the extension 68 is brought back and linked by means of splices or the gluing of the other end of the extension with the strap at a point 71, which is almost symmetrical with respect to the point 70 relative a center section of an adjacent portion 72 of the strap, so as to form an open loop 73 which is secured to the strap by means of its ends and thus utilized as a handle 19.

Of course, the encirclement can be realized in one direction or another and thus, the free extension 68, called upon to constitute the handle 19, will overlay a part adjacent to the strap handle from both left to right and right to left.

A somewhat modified approach to the abovementioned handle formed with the strap is shown in FIGS. 13 and 14.

According to this approach, the attachment points 74 and 75 previously located upon either side of the strap 72 are shifted to the longer sides so as not to create any undue stress upon the attachment points.

Indeed, the main stress exerted at the time the package is carried is distributed equally along a direction parallel to the longitudinal sides. Thus, the positioning of the splices in that case distributes the stress equally so as to avoid rupture at the moment the package is grasped or while it is being carried.

The loop of the handle 76 covers the total width of the adjacent face. It can, nevertheless, be considered an implementation equivalent to the aforesaid embodiment.

In order to avoid the embarassment due to the presence of a bulging loop which is in existence from the means of transportation to the presentation for sale, it can be envisaged to make the handle retractable, that is to let it asume a shape or take on a flattened position at which the strap portion forming the handle is juxtaposed in an optimum position with a section of the strap extending along an adjacent face as seen in FIG. 11 and 14.

This form can be realized, for instance, by means of two successive transverse folds 77 and 78, made within the loop portion 73 of the strap constituting the handle. Thus, this folded portion of the handle becomes flattened against the section 72 of the strap extending along the adjoining side during transportation and handling so as to avoid all danger of rupture or any trouble in general.

In order to readily visually recognize the handle, it may be preferred to make it of a color different from the remainder of the peripheral strap.

Of course, this difference is realized immediately in case the package is made of a color which perfectly contrasts with that of the strap.

Another variant consists in providing for an additional splicing location by shifting the location of the closure 70 of the encirclement in order to better center the strap portion forming the handle 19 with respect to the lateral side provided therefor.

This variant follows a more simple variant which might be designed to make the handle strap discontinuous or seperate with respect to the strap and to let the two attachment points 70 and 71 follow be achieved in a later processing phase subsequent to the encirclement per se, in the manner of an independent handle, set in and secured to the binding strap at each of its two ends.

Another variant consists in envisioning a composite encirclement with the aid of two half loops of the strap for each half perimeter, so as to make use of a handle at each end formed by means of the free end of one or the other half perimeters, with corresponding points of attachment.

Figure 15:
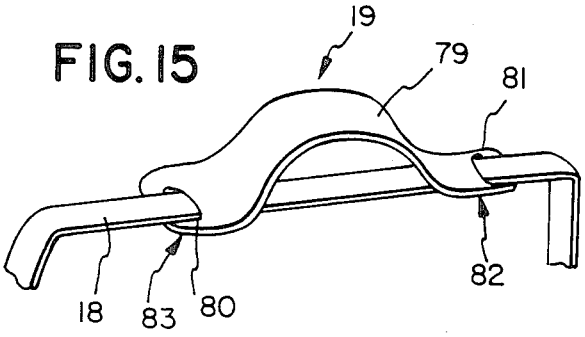
FIG. 15 is a perspective view of an embodiment of another type of integrated handle fitted onto the strap.
Figure 16:
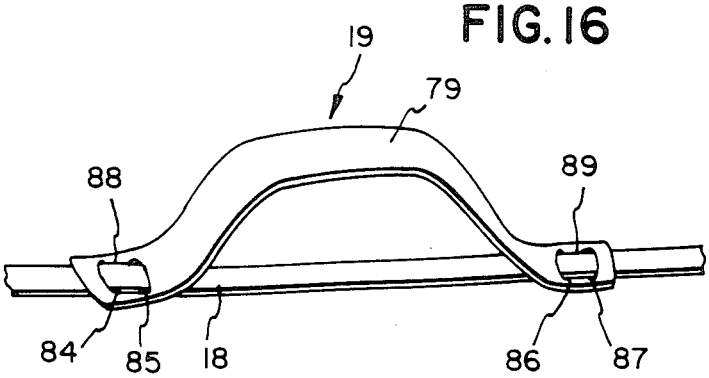
FIG. 16 is a perspective view of a detailed embodiment of another type of integrated handle, fitted onto the strap shown in FIG. 15.

Another variant relates to a handle which is threaded onto the strap as shown in FIGS. 15 and 16.

This handle is made of a flexible sliding piece forming a loop-type of handle, bulging away from the package envelope and passing through the lateral side of the package through means of the slot 42 of the opening 41.

With regard to the embodiment of the base of a perfected development shown in FIG. 15, a flexible handle 79 is attached to the binding means and is of greater length than the intervening strap and portion which is provided, close to each end, with a tranverse slit 80 and 81, which serve in turn, for the passage of the strap therethrough.

The flexible member may also be implemented by means of a member of greater length.

The so attached member forms a loop-type handle consisting of the handle 19, partially held in place by means of the pressure exerted upon the end parts 82 and 83 by means of the strap disposed in contact with the bodies of the adjacent articles, thus creating clamping or frictional resistance therebetween.

This fixture not only permits the handle to stay in place, but also to be at most minimally deformed under the effect of the force exerted upon the handle when the consumer grasps the handle and carries the package.

According to an embodiment shown in detail in FIG. 16, a dual passage for the strap is created, in the form of two closely disposed parallel slits 84, 85, 86 and 87 of the same shape, improving again the securement of the handle onto the strap through means of enlargement of the carrying zones 88 and 89 of the strap at the respective ends of the handle.

Figure 19:
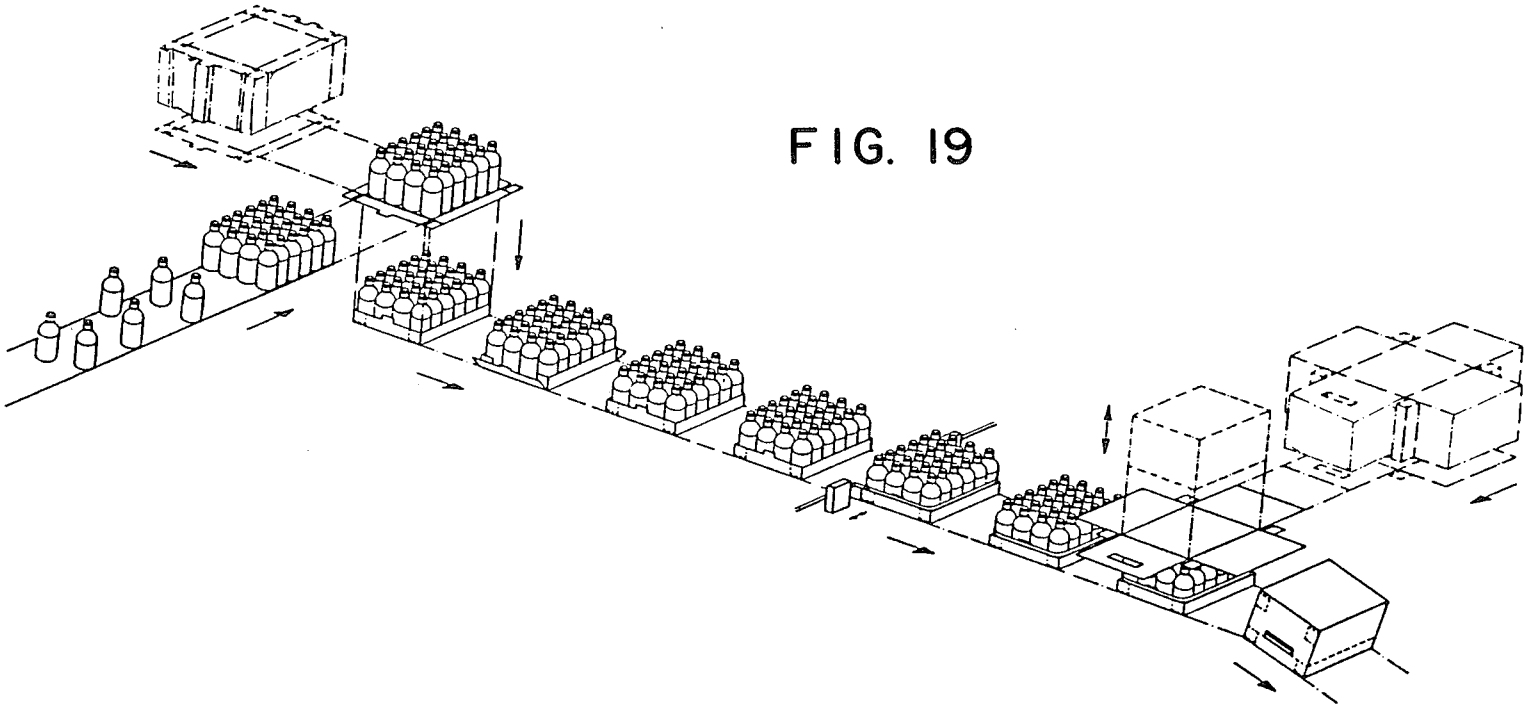
FIG. 19 is a schematic perspective view showing the process of forming the package around a set of bottles.

Hereinafter, the process of manufacture of the package will be described, according to the invention, by referring to FIG. 19.

The invention relates equally to the process of assembling the package, a process whose general concept is that a bottom member of the tray-shaped type serves as a confining member of the parcel for a group of containers 3 in order to permit its formation and thereafter facilitating emplacement of the strap and the tight encirclement thereof, and; the tray and the rims of the tray-shaped portion provide the necessary stability and cohesion for the group.

More precisely, the process consists in forming a group of containers, to place them upon a central zone of the tray-shaped portion 1 with turned up flaps, in raising the rim around the group, and in joining the flaps together in order to constitute a rim forming a barrier for the individual items of the group, thus also assuring the cohesion of the group, the aforesaid homogeneous and compact group lending itself easily to the encirclement by means of a plane strap, while assuring its initial cohesion throughout all operations of the encirclement thereof.

The formation or the mounting of the handle upon the strap is realized before or during the encirclement process.

In another variant, the rim can be adjusted to the dimensions of the containers before the introduction of the group into the space delineated by means of the the aforesaid rim with the aid of appropriate mechanization means. The rim plays the same role in the case of the retention of the group at the time of encirclement. In this manner the tray-shaped portion can also be used as a confining member.

The processes of packaging are finished by emplacement of the cover, whose rims of lateral panels are spliced to the turned up flaps of the tray-shaped portion through means of the closing of the rear face, and through means of the gluing of the closure panel at the front thereof.

It will be understood that the abovementioned invention is not limited to the sole means described, but on the contrary, direct variants, simple modifications, additions, omissions and substitutions without any inventive contribution are considered to be embodied within the scope of the present invention as defined by means of the appended claims.

I claim:

1. A packaging arrangement for a group of containers, comprising:

a first ray-shaped bottom member having a substantially planar bottom wall and circumferential sidewalls extending substantially perpendicularly upwardly from said bottom wall and constituting a peripheral rim that at least initially peripherally confines said group of containers arranged in a predetermined pattern upon said bottom wall;

a strap-shaped tying member, having handle means disposed thereon, tightly encircling said group of containers so as to hold said containers in said predetermined pattern;

a second cover member, separate and distinct from said first tray member, including a top wall and circumferential sidewalls extending substantially perpendicularly downwardly from said top wall so as to envelop said group of containers disposed upon said bottom tray member, and said strap-shaped tying member, and having means for securing said cover member to said bottom member so as to form a package therewith; and means defining an opening within a sidewall of said cover member for the passage of said handle means therethrough from the interior of said package to the exterior of said package.

2. The packaging arrangement as defined in claim 1, wherein said package has a substantially parallelepiped configuration.

3. The packaging arrangement as defined in claim 1, wherein said circumferential walls of said cover include four side walls extending substantially perpendicularly to one another and to said top wall and each having a top edge, a bottom edge, and two side edges, and four connecting walls each extending between said edges of adjacent ones of said side walls at respective obtuse angles with respect thereto.

4. The packaging arrangement as defined in claim 3, wherein said top wall of said cover has respective circumferential edges and said connecting walls have respective top edges; and wherein said cover further includes a plurality of upper edge walls extending between said circumferential edges of said top wall and said top edges of said side and connecting walls at respective obtuse angles with respect to such respective adjacent walls.

5. The packaging arrangement as defined in claim 1, wherein said opening in said cover has a slot-shaped configuration.

6. The packaging arrangement as defined in claim 1, wherein said handle means is of one piece with said tying member.

7. A packaging arrangement as set forth in claim 6, wherein:

said handle means comprises an enlarged loop portion defined at one end of said tying member.

8. The packaging arrangement as defined in claim 1, wherein said handle means has respective folds to enable such handle means to be introduced into and stored in an interspace between said tying member and said cover next to said opening.

9. The packaging arrangement as defined in claim 1, wherein said handle means is separate from said tying member and has two end portions each provided with a slot, said tying member passing through said slots of said handle means and clamping said handle means between itself and the containers of the group upon tightening of said tying member.

10. A packaging arrangement as set forth in claim 1, wherein:

said tray and cover members are fabricated from corrugated cardboard.

11. A packaging arrangement as set forth in claim 1, wherein:

said tray and cover members are fabricated from plastic material.

12. A packaging arrangement as set forth in claim 1, wherein:

said handle means is separate from said tying member and secured to longitudinal side portions of said tying member tightly encircling said group of containers.

13. A packaging arrangement for a group of containers, produced by a method comprising the steps of:

initially confining said group of containers in a predetermined pattern upon a substantially planar bottom wall of a first tray-shaped bottom member and between circumferential sidewalls extending substantially perpendicularly upwardly from said bottom wall so as to constitute a peripheral rim;

tightly encircling said group of containers disposed upon said first tray-shaped bottom member with a strap-shaped tying member, having handle means disposed thereon, so as to retain said containers in said predetermined pattern;

placing a second cover member, separate and distinct from said first tray-shaped bottom member, including a top wall and circumferential sidewalls extending substantially perpendicularly downwardly from said top wall, with an opening defined within one of said sidewalls, over and around said group of containers, and said tying member tightly encircled thereon, such that said containers and said tying member are completely enveloped and encased within said second cover member with said opening of said second cover member being substantially aligned with said handle means of said tying member so as to provide access to said handle means of said tying member from a position exterior to said cover member; and securing said second cover member to said first tray-shaped bottom member so as to complete said package for said group of containers.

14. A packaging arrangement as set forth in claim 13, wherein said confining step comprises:

placing said group of containers in said predetermined pattern upon a central portion of a packaging blank to be formed into said tray-shaped bottom member, wherein said blank includes a plurality of flaps disposed circumferentially about and extending outwardly from said central portion;

subsequently raising said flaps upwardly about said group of containers; and connecting said flaps together so as to form said peripheral rim portion of said tray-shaped bottom member.

15. A packaging arrangement as set forth in claim 13, wherein:

said peripheral rim portion of said first tray-shaped bottom member is formed prior to said confining of said group of containers upon said tray-shaped bottom member.

16. A packaging arrangement as set forth in claim 13, wherein said encircling step comprises:

providing said strap-shaped tying member with a length which is greater than the circumferential extent about said confined group of containers;

fixing one end of said strap-shaped tying member to a first intermediate portion of said tying member so as to complete said step of tightly encircling said group of containers, and fixing the other end of said tying member of a second intermediate portion of said tying member which is spaced a distance from said first intermediate portion of said tying member which is less than the length defined between said first intermediate portion of said tying member and said other end of said tying member so as to define said handle means having a loop-type configuration.

17. A packaging arrangement as set forth in claim 16, wherein:

said handle means is formed with a plurality of folded portions such that said handle means may be housed in a folded state interiorly within said cover member.

18. A packaging arrangement as set forth in claim 13, wherein:

said tray-shaped bottom member and said cover member are fabricated from corrugated cardboard.

19. A packaging arrangement as set forth in claim 13, wherein:

said tray-shaped bottom member and said cover member are fabricated from plastic material.

20. A packaging arrangement as set forth in claim 13, wherein:

said handle means is formed from material separate and distinct from said strap-shaped tying member; and opposite ends of said handle means are secured to longitudinally extending portions of said strap-shaped tying member disposed about said group of containers.

* * * * *